US006413144B1

(12) United States Patent
Williams

(10) Patent No.: US 6,413,144 B1
(45) Date of Patent: Jul. 2, 2002

(54) HAND-HELD TOY FOR LIGHTING WHEN SPUN

(76) Inventor: Colin Williams, 3115 New England Thruway, Apt. #1, Bronx, NY (US) 10469

( * ) Notice: Subject to any disclaimer, the term of this patent is extended or adjusted under 35 U.S.C. 154(b) by 0 days.

(21) Appl. No.: 09/729,070

(22) Filed: Dec. 4, 2000

(51) Int. Cl.[7] ..... A63H 29/22
(52) U.S. Cl. ..... 446/484; 446/236; 446/235
(58) Field of Search ..... 446/236, 242, 446/248, 252, 235, 485

(56) References Cited

U.S. PATENT DOCUMENTS 1,249,004 A * 12/1917 Bianchi ..... 446/252
3,803,757 A * 4/1974 Sanchez ..... 446/242
3,924,114 A * 12/1975 Sanchez ..... 446/242
4,277,912 A * 7/1981 Hsien ..... 446/233
4,282,679 A 8/1981 Grubb et al.
4,588,387 A 5/1986 Swenson
5,032,101 A * 7/1991 Hartman ..... 446/262
5,138,535 A 8/1992 Aragon, Jr.
5,713,782 A 2/1998 Jensen et al.
5,791,966 A * 8/1998 Capps et al. ..... 446/242
6,036,576 A 3/2000 Colon, Jr.
6,072,280 A * 6/2000 Allen ..... 315/185 S
6,083,076 A * 7/2000 Saint-Victor ..... 446/242
6,270,391 B1 * 8/2001 Emilsson ..... 446/47

* cited by examiner

*Primary Examiner*—Jacob K. Ackun
*Assistant Examiner*—Faye Francis
(74) *Attorney, Agent, or Firm*—Richard L. Miller, P.E.

(57) ABSTRACT

A hand-held toy that lights when spun, and which includes a rod, a head attached to, and spins with, the rod, a light source illuminates with movement of, the head, and apparatus associated with the light source, and which is grasped by the hands of a user. The head is either spherically-shaped or a pair of stacked disks. The light source includes a plurality of bulbs that are disposed on the head, a pair of battery interfaces that are in electrical communication with the plurality of bulbs and hold, and electrically communicate with, a pair of batteries, and a centrifugal switch that is electrical communication with the plurality of bulbs, and which closes when the head is spun, and when closed, illuminates the plurality of bulbs so as to allow the plurality of bulbs to illuminate when the head is spun. The apparatus includes a shell that rotatably receives the rod, and which is grasped by one hand of the user, a pull cord that normally winds around the rod and has a handle that is grasped by the other hand of the user, and when the shell is grasped by the one hand of the user, and the handle is grasped and pulled by the other hand of the user, the pull cord unwinds from the rod, which causes the rod to spin, which causes the head to spin, and which causes the light source to illuminate.

14 Claims, 1 Drawing Sheet

HAND-HELD TOY FOR LIGHTING WHEN SPUN

BACKGROUND OF THE INVENTION

1. Field of the Invention

The present invention relates to a hand-held toy. More particularly, the present invention relates to a hand-held toy for lighting when spun.

2. Description of the Prior Art

Numerous innovations for toys and the like have been provided in the prior art that will be described. Even though these innovations may be suitable for the specific individual purposes to which they address, however, they differ from the present invention.

A first example, U.S. Pat. No. 4,282,679 to Grubb et al. teaches an infant's toy with a hollow ball having openings disposed about its surface and having a freely movable insert trapped within the hollow ball, said insert provided with a pair of pivotally connected stems with a cage structure disposed at the end of each stem, each cage structure containing at least one loosely confined ball. The cage structures are readily movable in and out of the openings of the hollow ball but the insert is restrained from being removed from the hollow ball.

A second example, U.S. Pat. No. 4,588,387 to Swenson teaches a rattle for an infant wherein the noise making device within the rattle also is a light activation device to momentarily light, in sequence, a plurality of lights mounted on the rattle. The noise-making is made of magnetic material and is moved back and forth in a tube within the rattle so as to activate reed switches adjacent to the tube thereby sequentially illuminating the lights. The device is powered by batteries mounted in a handle on the rattle.

A third example, U.S. Pat. No. 5,138,535 to Aragon Jr. teaches a baby rattle that is made up of a light-transparent shell, a light source in the interior of the shell, an impact or motion-sensing member within the shell will generate an electrical signal to activate a control circuit between the light source and a portable power source to illuminate the shell. The impact motion-sensing member is preferably a piezo-electric crystal mounted within the shell, and a fiber optic array within the shell can be used in association with a light source to create different lighted displays.

A fourth example, U.S. Pat. No. 5,713,782 to Jensen et al. teaches a baby rattle comprising two rattle portions and an elongated elastic spacer element which connects the two rattle portions, wherein the two rattle portions have mutually complementary coupling portions which allow the two rattle portions to be coupled to each other, and wherein the weight of the two rattle portions and the rigidity of the elastic spacer element are adjusted relative to each other so that the elastic spacer element, like a column, may in itself support the one rattle portion when the elastic spacer element is maintained substantially vertically upright relative to the second rattle portion and wherein the mutually complementary coupling portions possess sufficient coupling force to keep the two rattle portions together despite the force applied from the elongated elastic spacer element by coupling of the rattle portions. Hereby a baby rattle is provided which makes many play options available by use of only a few constituents.

A fifth example, U.S. Pat. No. 6,036,576 to Colon Jr. teaches a light sword toy comprising a tube having a proximal end and a distal end, and a light source located at the proximal end of the tube. The light source directs light into the tube toward the distal end. The tube is made of a translucent material which glows when the light source is activated. A ball is contained within the tube, and is capable of moving between the proximal end and distal end thereof. When the ball is initially at the proximal end, it blocks nearly all of the light from the light source from reaching the distal end. When the ball is subsequently rolled toward the distal end, the illumination appears to travel toward the distal end. A ball retaining mechanism is located at the distal end for holding the ball at the distal end until the end of play. Then the ball is releasable by the user to restore the ball to the proximal end of the tube.

It is apparent that numerous innovations for toys and the like have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, an object of the present invention is to provide a hand-held toy for lighting when spun that avoids the disadvantages of the prior art.

Another object of the present invention is to provide a hand-held toy for lighting when spun that is simple and inexpensive to manufacture.

Still another object of the present invention is to provide a hand-held toy for lighting when spun that is simple to use.

Briefly stated, still yet another object of the present invention is to provide a hand-held toy that lights when spun, and which includes a rod, a head attached thereto, and spins with, the rod, a light source illuminates with movement of, the head, while the apparatus associated with the light source, is grasped by the hands of a user. The head is either spherically-shaped or a pair of stacked disks. The light source includes a plurality of bulbs that are disposed on the head, a pair of battery interfaces that are in electrical communication with the plurality of bulbs and hold, and electrically communicate with, a pair of batteries, and a centrifugal switch that is electrical communication with the plurality of bulbs, and which closes when the head is spun, and when closed, illuminates the plurality of bulbs so as to allow the plurality of bulbs to illuminate when the head is spun. The apparatus includes a shell that rotatably receives the rod, and which is grasped by one hand of the user, a pull cord that winds around the rod and has a handle that is grasped by the other hand of the user, and when the shell is grasped by the one hand of the user, and the handle is grasped and pulled by the other hand of the user, the pull cord unwinds from the rod, which causes the rod to spin, which causes the head to spin, and which causes the light source to illuminate.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

First Embodiment

Figure 1:
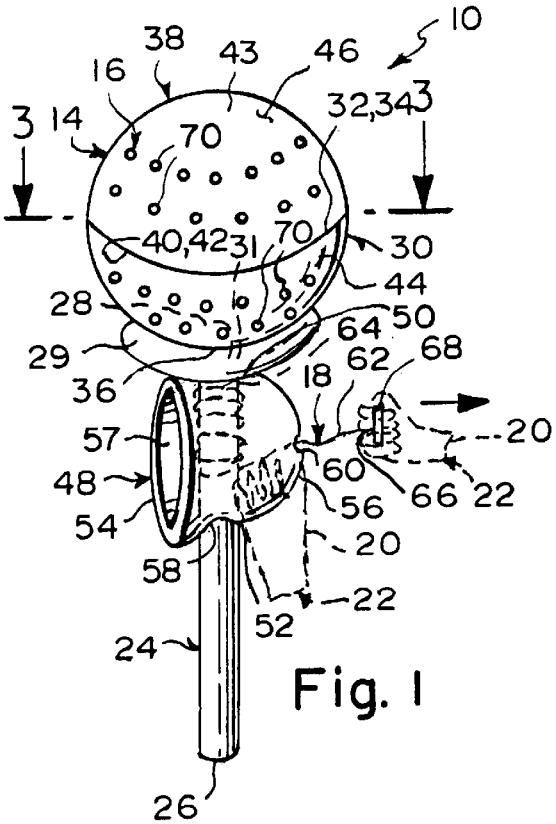
FIG. 1 is a diagrammatic perspective view of a first embodiment of the present invention.

10 hand-held toy of present invention for lighting when spun
14 head
16 light source
18 apparatus for holding by hands 20 of user 22
20 hands of user 22
22 user
24 rod
26 free proximal end of rod 24
28 distal end of rod 24
29 collar
30 lower half of head 14
31 ring of collar 29
32 top of lower half 30 of head 14
34 perimeter defining top 32 of lower half 30 of head 14
36 lowermost point of lower half 30 of head 14
38 upper half of head 14
40 bottom of upper half 38 of head 14
42 perimeter defining bottom 40 of upper half 38 of head 14
43 uppermost point of upper half 38 of head 14
44 outermost surface of lower half 30 of head 14
46 outermost surface of upper half 38 of head 14
48 shell of apparatus 18
50 uppermost point of shell 48 of apparatus 18
52 lowermost point of shell 48 of apparatus 18
54 first side of shell 48 of apparatus 18
56 second side of shell 48 of apparatus 18 for grasping by one hand 20 of user 22
57 chamber contained in shell 48 of apparatus 18
58 throughbore through shell 48 of apparatus 18
60 bore in shell 48 of apparatus 18
62 pull cord of apparatus 18
64 first end of pull cord 62 of apparatus 18
66 second end of pull cord 62 of apparatus 18
68 handle of pull cord 62 of apparatus 18 for grasping by other hand 20 of user 22
70 plurality of bulbs of light source 16
72 pair of battery interfaces of light source 16 for holding, and electrically communicating with, pair of batteries 74
74 pair of batteries
76 centrifugal switch of light source 16

Second Embodiment

110 hand-held toy of present invention for lighting when spun
114 head
130 lower half of head 114
138 upper half of head 114

DESCRIPTION OF THE PREFERRED EMBODIMENT

Referring now to the figures, in which like numerals indicate like parts, and particularly to FIG. 1, a first embodiment of the hand-held toy of the present invention is shown generally at 10 for lighting when spun.

The configuration of the hand-held toy 10 can best be seen in FIG. 1, and as such, will be discussed with reference thereto.

The hand-held toy 10 comprises a rod 24.

The hand-held toy 10 further comprises a head 14 that is attached to, and spins with, the rod 24.

The hand-held toy 10 further comprises a light source 16 that illuminates with movement of, the head 14.

The hand-held toy 10 further comprises apparatus 18 that is associated with the light source 16 for holding by the hands 20 of a user 22.

The rod 24 is slender and elongated.

The rod 24 has a free proximal end 26 and a distal end 28.

The head 14 is fixedly attached to the distal end 28 of, and spins with, the rod 24.

The hand-held toy 10 further comprises a collar 29 that is a ring 31.

The ring 31 encircles the distal end 28 of the rod 24 and has the head 14 rest thereupon.

The head 14 is divided into a lower half 30.

The head 14 is spherically-shaped.

The lower half of the head 14 is hemispherically-shaped and hollow.

The lower half 30 of the head 14 has a top 32.

The top 32 of the lower half 30 of the head 14 is flat, open, and defined by a perimeter 34.

The perimeter 34 of the top 32 of the lower half 30 of the head 14 is threaded.

The lower half 30 of the head 14 further has a lowermost point 36 to which the distal end 28 of the rod 24 is attached, and from which the rod 24 depends, and which rests upon the ring 34.

The head 14 is further divided into an upper half 38.

The upper half 38 of the head 14 is hemispherically-shaped and hollow.

The upper half 38 of the head 14 has a bottom 40.

The bottom 40 of the upper half 38 of the head 14 is flat, open, and defined by a perimeter 42.

The perimeter 42 of the bottom 40 of the upper half 38 of the head 14 is threaded.

The perimeter 42 of the bottom 40 of the upper half 38 of the head 14 selectively threads to the perimeter 34 of the top 32 of the lower half 30 of the head 14.

The upper half 38 of the head 14 further has an uppermost point 43.

The lower half 30 of the head 14 further has an outermost surface 44.

The outermost surface 44 of the lower half 30 of the head 14 extends completely from the perimeter 34 of the top 32 of the lower half 30 of the head 14, to the lowermost point 36 of the lower half 30 of the head 14.

The upper half 38 of the head 14 further has an outermost surface 46.

The outermost surface 46 of the upper half 38 of the head 14 extends completely from the perimeter 42 of the bottom 40 of the upper half 38 of the head 14, to the uppermost point 43 of the upper half 38 of the head 14.

The apparatus 18 comprises a shell 48 that rotatably receives the rod 24.

The shell 48 is disposed on the distal end 28 of the rod 24, below, and touching, the ring 34.

The shell 48 is flattened sphere-shaped with a portion removed.

The shell 48 has an uppermost point 50 that touches the ring 34, a lowermost point 52, a first side 54 that is vertically-oriented, open and straight, a second side 56 that is convex-shaped for grasping by one hand 20 of the user 22, and contains a chamber 57 that opens into the first side 54 of the shell 48.

The shell 48 further has a throughbore 58 that extends vertically therethrough, extends from, and opens into, the uppermost point 50 of the shell, to, and opens into, the lowermost point 52 of the shell 48, communicates with the chamber 57 contained in the shell 48, and rotatably receives the rod 24 therethrough.

The shell 48 further has a bore 60 that extends horizontally and centrally through the second side 56 of the shell 48, and communicates with the chamber 57 contained in the shell 48.

The apparatus 18 further comprises a pull cord 62 that normally winds around the rod 24, and has a first end 64 that is fixedly attached to the rod 24, and a second end 66 that extends freely and outwardly through the bore 60 in the shell 48.

The pull cord 62 further has a handle 68 that is attached to the second end 66 of the pull cord 62, externally to the shell 48, for grasping by the other hand 20 of the user 22, and when the shell 48 is grasped by the one hand 20 of the user 22 and the handle 68 is grasped and pulled by the other hand 20 of the user 22, the pull cord 62 unwinds from the rod 24, which causes the rod 24 to spin, which causes the head 14 to spin, and which causes the light source 16 to illuminate.

Figure 2:
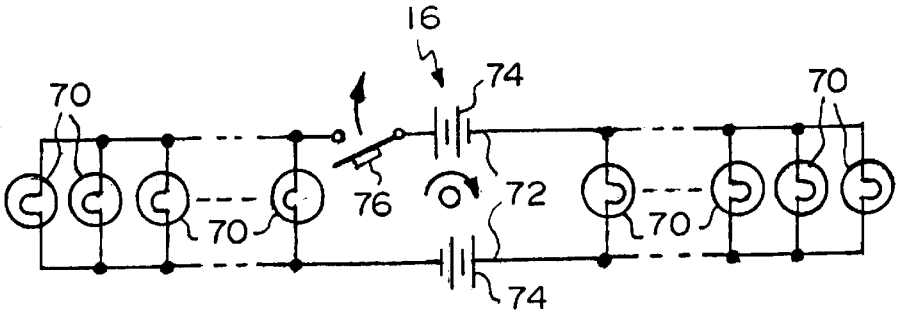
FIG. 2 is a schematic diagram of the light circuit of the present invention.
Figure 3:
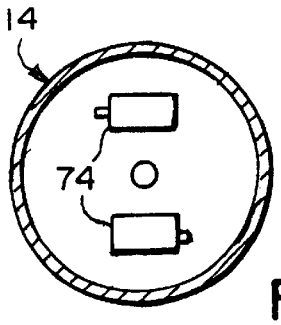
FIG. 3 is a diagrammatic cross sectional view taken on line 3—3 in FIG. 1 illustrating the position of the pair of batteries.

The configuration of the light source 16 can best be seen in FIGS. 1–3, and as such, will be discussed with reference thereto.

The light source 16 comprises a plurality of bulbs 70 that are in electrical communication with each other.

The plurality of bulbs 70 are in parallel electrical communication with each other so as to allow a remaining portion of the plurality of bulbs 70 to illuminate if any bulbs of the plurality of bulbs 70 burn out.

The light source 16 further comprises a pair of battery interfaces 72 that are in electrical communication with the plurality of bulbs 70 for holding, and electrically communicating with, a pair of batteries 74.

The pair of battery interfaces 72 are disposed in the head 14, at diametrically opposed positions therein, for allowing the pair of batteries 74 held thereby to maintain balance of the head 14 as it spins.

All of the plurality of bulbs 70 are blinking bulbs.

All of the plurality of bulbs 70 are not blinking bulbs.

A portion of the plurality of bulbs 70 are blinking bulbs and a remaining portion of the plurality of bulbs 70 are not blinking bulbs.

The plurality of bulbs 70 are disposed on the outermost surface 46 of the upper half 38 of the head 14 and the outermost surface 44 of the lower half 30 of the head 14.

The light source 16 further comprises a centrifugal switch 76 that is disposed in the head 14, is in electrical communication with the plurality of bulbs 70, and which closes when the head 14 is spun, and when closed, illuminates the plurality of bulbs 70 so as to allow the plurality of bulbs 70 to illuminate when the head 14 is spun.

Figure 4:
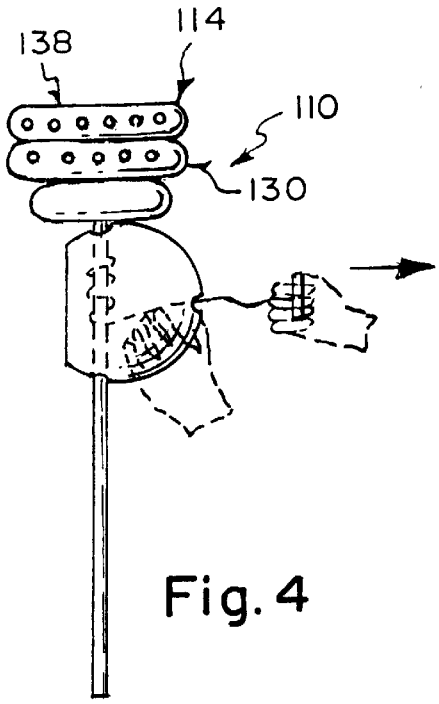
FIG. 4 is a diagrammatic perspective view of a second embodiment of the present invention.

The configuration of a second embodiment of the hand-held toy 110 can best be seen in FIG. 4, and as such, will be discussed with reference thereto.

The hand-held toy 110 is similar to the hand-held toy 10, except:

1. The upper half 138 of the head 114 is disk-shaped and hollow.
2. The lower half 130 of the head 114 is disk-shaped and hollow.

It will be understood that each of the elements described above, or two or more together, may also find a useful application in other types of constructions differing from the types described above.

While the invention has been illustrated and described as embodied in a rattle toy for lighting when spun, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hand-held toy for lighting when spun, comprising:

A) a rod;

B) a head attached to, and spinning with, said rod;

C) a light source illuminating with movement of, said head; and

D) apparatus associated with said light source, for holding by the hands of a user, wherein said rod has:

i) a free proximal end; and ii) a distal end; further comprising a collar that is a ring, wherein said apparatus comprises a shell that rotatably receives said rod, wherein said shell has:

a) an uppermost point that touches said ring;

b) a lowermost point;

c) a first side that is vertically-oriented, open and straight;

d) a second side that is convex-shaped for grasping by one hand of the user; and e) a chamber that opens into said first side of said shell.

2. The toy as defined in claim 1, wherein said shell further has a throughbore that extends vertically therethrough, extends from, and opens into, said uppermost point of said shell, to, and opens into, said lowermost point of said shell, communicates with said chamber contained in said shell, and rotatably receives said rod therethrough.

3. The toy as defined in claim 1, wherein said shell further has a bore that extends horizontally and centrally through said second side of said shell, and communicates with said chamber contained in said shell.

4. The toy as defined in claim 3, wherein said apparatus further comprises a pull cord that winds around said rod, and has:

a) a first end that is fixedly attached to said rod; and b) a second end that extends freely and outwardly through said bore in said shell.

5. The toy as defined in claim 4, wherein said pull cord further has a handle that is attached to said second end of said pull cord, externally to said shell, for grasping by the other hand of the user, and when said shell is grasped by the one hand of the user and said handle is grasped and pulled by the other hand of the user, said pull cord unwinds from said rod, which causes said rod to spin, which causes said head to spin, and which causes said light source to illuminate.

6. The toy as defined in claim 1, wherein said light source comprises a plurality of bulbs that are in electrical communication with each other.

7. The toy as defined in claim 6, wherein said plurality of bulbs are in parallel electrical communication with each other so as to allow a remaining portion of said plurality of bulbs to illuminate if any bulbs of said plurality of bulbs burn out.

8. The toy as defined in claim 6, wherein said light source further comprises a pair of battery interfaces that are in electrical communication with said plurality of bulbs for holding, and electrically communicating with, a pair of batteries.

9. The toy as defined in claim 8, wherein said pair of battery interfaces are disposed in said head, at diametrically opposed positions therein, for allowing the pair of batteries held thereby to maintain balance of said head as it spins.

10. The toy as defined in claim 6, wherein all of said plurality of bulbs are blinking bulbs.

11. The toy as defined in claim 6, wherein all of said plurality of bulbs are not blinking bulbs.

12. The toy as defined in claim 6, wherein a portion of said plurality of bulbs are blinking bulbs and a remaining portion of said plurality of bulbs are not blinking bulbs.

13. The toy as defined in claim 6, wherein said plurality of bulbs are disposed on an outermost surface of an upper half of said head and an outermost surface of an lower half of said head.

14. The toy as defined in claim 6, wherein said light source further comprises a centrifugal switch that is disposed in said head, is in electrical communication with said plurality of bulbs, and which closes when said head is spun, and when closed, illuminates said plurality of bulbs so as to allow said plurality of bulbs to illuminate when said head is spun.

* * * * *